US005913551A

United States Patent [19]

Tsutsumi et al.

[11] Patent Number: 5,913,551

[45] Date of Patent: Jun. 22, 1999

[54] METHOD OF PRODUCING AN INDUCTOR

[75] Inventors: Yutaka Tsutsumi, Neyagawa; Haruhiko Kuwata, Osaka; Makoto Shinada, Yawata; Hiroshi Momoi, Hirakata; Shinji Nakamura, Matsudo, all of Japan

[73] Assignee: Matsushita Electric Industrial Co., Ltd., Osaka, Japan

[21] Appl. No.: 08/668,970

[22] Filed: Jun. 21, 1996

Related U.S. Application Data

[62] Division of application No. 08/504,888, Jul. 20, 1995, Pat. No. 5,751,203.

[30] Foreign Application Priority Data

Jul. 20, 1994 [JP] Japan ..... 6-167942
May 8, 1995 [JP] Japan ..... 7-109246

[51] Int. Cl.[6] ..... H01F 41/06

[52] U.S. Cl. ..... 29/605; 29/827

[58] Field of Search ..... 29/605, 827; 336/192, 336/83

[56] References Cited

U.S. PATENT DOCUMENTS

| | | | |
|---|---|---|---|
| 3,859,614 | 1/1975 | Reithmaier | 336/83 |
| 4,149,135 | 4/1979 | Roespel et al. | 29/605 X |
| 4,656,450 | 4/1987 | Jarosz et al. | 336/192 |
| 4,769,625 | 9/1988 | Meindl | 336/65 |
| 4,888,571 | 12/1989 | Kobayashi et al. | 336/65 |
| 5,307,041 | 4/1994 | Kato et al. . | |

FOREIGN PATENT DOCUMENTS

| | | |
|---|---|---|
| 0212812 | 3/1987 | European Pat. Off. . |
| 4223097 A1 | 1/1993 | Germany . |
| 58-223306 | 12/1983 | Japan . |
| 59-101811 | 6/1984 | Japan . |
| 4-96812 | 8/1992 | Japan . |
| 6-44532 | 6/1994 | Japan . |

OTHER PUBLICATIONS

European Search Report Dated Nov. 27, 1995.

*Primary Examiner*—Carl E. Hall
*Attorney, Agent, or Firm*—Ratner & Prestia

[57] ABSTRACT

In an inductor including a magnetic core on a top surface of a terminal table, a plurality of L-shaped conductors are inserted into the terminal table so that two ends of each of the L-shaped conductors are projecting from a side surface of the terminal table. The plurality of L-shaped conductors each have at least one stepped portion. One of the two ends which is on a higher level than the stepped portion acts as a winding terminal around which the wire is wound, and the other end which is on a lower level than the stepped portion acts as a mounting terminal used for mounting of the inductor. The winding terminal is projecting from a higher level of the side surface of the terminal table than the mounting terminal.

4 Claims, 9 Drawing Sheets

METHOD OF PRODUCING AN INDUCTOR

This application is a division of application Ser. No. 08/504,888, filed Jul. 20, 1995, now U.S. Pat. No. 5,751, 203.

BACKGROUND OF THE INVENTION

1. Field of the Invention

The present invention relates to an inductor for surface mounting used for a battery-driven electronic device or the like and a method for producing the same.

2. Description of the Related Art

FIG. 14 is a partially cut perspective view of a conventional inductor 50. FIG. 15 is an isometric view of a terminal 31 of the inductor 50. FIGS. 16A through 16E are isometric views illustrating a method for producing the inductor 50.

As shown in FIGS. 14 and 15, the terminal 31 is drawn outside from an intermediate level part of a side surface of a terminal table 30 (namely, an intermediate part of the side surface in the thickness direction); The terminal 31 is bent to be step-like. The terminal 31 includes a tip portion 31*a*, and the inductor 50 is mounted on an electronic device or the like in the state where a bottom surface of the tip portion 31*a* is in contact with a substrate of the electronic device or the like. The bottom surface of the tip portion 31*a* is on the same level as a bottom surface of the terminal table 30.

On a top surface of the terminal table 30, a drum-shaped core 28 is provided. The drum-shaped core 28 has a top flange 28*b*, a bottom flange 28*c*, and a central part 28*a* interposed between the top flange 28*b* and the bottom flange 28*c* and having a smaller diameter than the top and bottom flanges 28*b* and 28*c*. A wire 29 is wound around the central part 28*a*. Two ends 34 (only one is shown in FIG. 14) of the wire 29 are wound around a foot of the terminals 31 on the terminal table 30 and are treated by, for example, soldering for more secure electric connection to the terminals 31.

A cap-like core 27 covers the drum-shaped core 28, and is adhered to the terminal table 30 at contact surfaces thereof. The cap-like core 27 and the drum-shaped core 28 form a magnetic core of the inductor 50.

A method for producing an inductor 50 will be described with reference to FIGS. 16A through 16E.

As shown in FIG. 16A, a prescribed pattern is punched in a strip-like metal plate 33 by a pressing mold to form a lead frame 32 having guide holes 35 at prescribed positions and T-shaped terminal strips 31*b* extending inward from the lead frame 32. Next, the lead frame 32 is set in a resin molding apparatus (not shown). Then, insert molding is performed using a mold to form a terminal table 30 having the T-shaped terminal strips 31*b* inserted therethrough, as shown in FIG. 16B.

Next, the terminal strips 31*b* are cut to separate the terminal table 30 from the lead frame 32 as is shown in FIG. 16C. As shown in FIG. 16D, the terminal strips 31*b* are bent using a press mold to obtain step-like terminals 31.

Then, as shown in FIG. 16E, a drum-shaped core 28 is adhered on a top surface of the terminal table 30. A wire 29 is wound around a central part 28*a* of a drum-shaped shaped core. 28, and a cap-like core 27 (FIG. 14) is provided to cover the drum-shaped core 28 to form a magnetic core. Thus, the inductor 50 is completed.

As described above, the step-like terminals 31 of the conventional inductor 50 are formed by bending the T-shaped terminal strips 31*b* inserted through the terminal table 30. When the terminal strips 31*b* are bent, a mechanical stress is applied. Such a mechanical stress often causes generation of cracks in the terminal table 30, thereby lowering the mechanical strength of the terminals 31.

By bending the terminal strips 31*b* in this manner, the shape and the size of the terminals 31 are difficult to control with high precision. In the case where the terminals 31 do not have the shape and the size as designed, the inductor 50 including such terminals is not electrically connected to a printed circuit board in a satisfactory manner when the inductor 50 is mounted on a surface of the printed circuit board, resulting in defective mounting.

In the conventional inductor 50, two ends 34 of the wire 29 are wound around a foot of the terminals 31, which extend from the terminal table 30, and further soldered for more secure electric connection to the terminals 31. The winding process also provides a mechanical stress and thus can cause non-uniformity in the size of the terminals 31. Such difficulty in obtaining a satisfactorily precise size often causes defective mounting.

Moreover, in the conventional method for producing the inductor 50, after the terminal table 30 having the T-shaped terminal strips 31*b* inserted therethrough is formed by insert molding, the terminal strips 31*b* are cut to separate-the terminal table 30 from the lead frame 32. The terminal table 30 having the terminal strips 31*b* inserted therethrough, namely, an inductor in a half-completed state, is transported for further processing. During the transportation, the terminals 31 are exposed to mechanical stress, resulting in lower reliability and lower size precision of the terminals 31.

SUMMARY OF THE INVENTION

According to one aspect of the present invention, an inductor includes: a terminal table having a projecting portion at each of four corners of a top surface thereof; a plurality of L-shaped conductors inserted through the terminal table and each having two ends projecting from a side surface of the terminal table; and a magnetic core located on the top surface of the terminal table. The magnetic core includes at least a drum-shaped core having a wire wound around a central part thereof. The plurality of L-shaped conductors each have at least one stepped portion between the two ends. One of the two ends which is on a higher level than the stepped portion acts as a winding terminal around which the wire is allowed to be wound, and the other end which is on a lower level than the stepped portion acts as a mounting terminal used for mounting of the inductor, the winding terminal being projecting from a higher level of the side surface of the terminal table than the mounting terminal.

In one embodiment of the invention, the terminal table has at least one groove running from one side to another side of a bottom surface thereof.

In another embodiment of the invention, the terminal table has a projection on the top surface thereof, the drum-shaped core has a bottom flange including a bottom surface of the drum-shaped core, and the bottom flange has a recess in the bottom surface, the recess being engageable with the projection of the terminal table.

In still another embodiment of the invention, the drum-shaped core has an outer circumferential surface which is held by an inner side circumferential surface of each of the projecting portions.

In still another embodiment of the invention, the terminal table further has a stepped-up portion between the top surface thereof and the projecting portions, and the magnetic core further includes another core located around the drum-shaped core. The drum-shaped core has an outer circumferential surface which is held by an inner side circumferential surface of the stepped-up portion. The another core has an outer circumferential surface which is held by an inner side circumferential surface of each of the projecting portions.

In still another embodiment of the invention, the another core is a cylindrical core located around the outer circumferential surface of the drum-shaped core.

In still another embodiment of the invention, the another core is a cap-like core covering a top surface and the outer circumferential surface of the drum-shaped core.

In still another embodiment of the invention, the level of the mounting terminals and the level of the winding terminals have a difference of approximately 0.2 mm to 1.0 mm, and the plurality of L-shaped conductors each have two stepped portions.

According to another aspect of the present invention, a method for producing an inductor includes the steps of: treating a strip-like metal plate with press working to form a lead frame and a terminal area interposed between two areas of the lead frame extending in a longitudinal direction of the strip-like metal plate, the lead frame and the terminal area being formed in a prescribed pattern; mounting a terminal table on the terminal area; mounting a magnetic core on the terminal table; winding a wire around the magnetic core; and separating an assembly including the terminal table, magnetic core, and the wire from the lead frame.

In one embodiment of the invention, the terminal area includes a plurality of L-shaped conductors, and the step of treating the strip-like metal plate with press working includes the step of forming at least one stepped portion in each of the plurality of L-shaped conductors to obtain a prescribed level difference between the level of one of two ends of each L-shaped conductor and the level of the other end of the L-shaped conductor.

In another embodiment of the invention, the step of forming at least one stepped portion includes the step of bending each of the L-shaped conductors a plurality of times to form two stepped portions to obtain the level difference of approximately 0.2 mm to 1.0 mm.

In still another embodiment of the invention, the method further includes the step of cutting off a part of each of the plurality of L-shaped conductors extending in a width direction of the strip-like metal plate from the lead frame before the step of mounting the terminal table.

In still another embodiment of the invention, the terminal area includes a plurality of L-shaped conductors. The step of treating the strip-like metal plate with press working includes the step of forming at least one stepped portion in each of the plurality of L-shaped conductors to obtain a prescribed level difference between the level of one of two ends of each L-shaped conductor and the level of the other end of the L-shaped conductor. One of the two ends which is on a higher level than the stepped portion acts as a winding terminal around which the wire is allowed to be wound, and the other end which is on a lower level than the stepped portion acts as a mounting terminal used for mounting of the inductor. The terminal table is mounted on the terminal area in such a manner as to allow the winding terminal to project from a higher level of a side surface of the terminal table than the mounting terminal.

Thus, the invention described herein makes possible the advantages of providing an inductor for surface mounting which includes a terminal having an improved size precision and is improved in productivity and mounting quality such as positional precision and reliability; and a method for producing such an inductor.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

Figure 1:
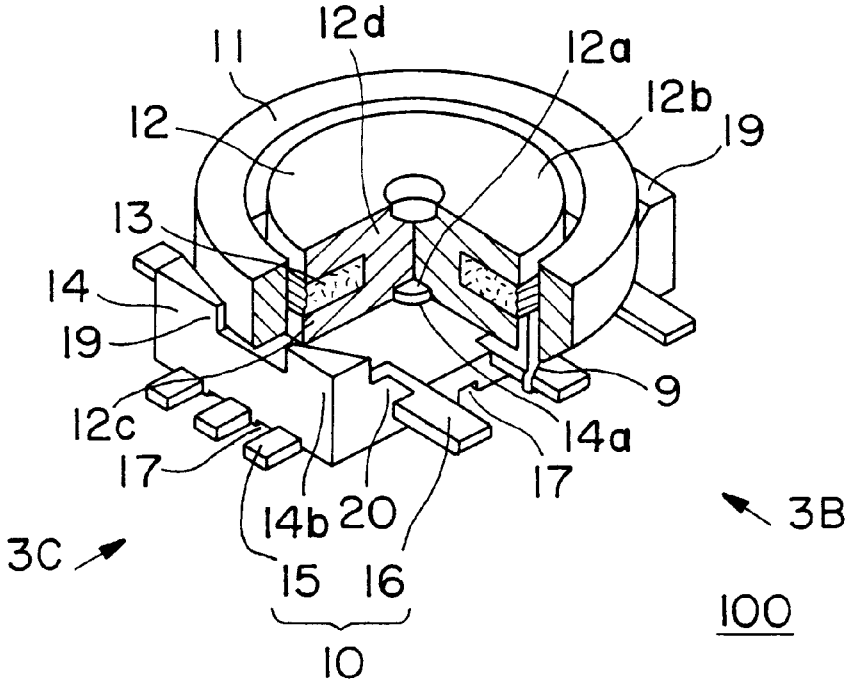
FIG. 1 is a partially cut perspective view of an inductor in an example according to the present invention.
Figure 2:
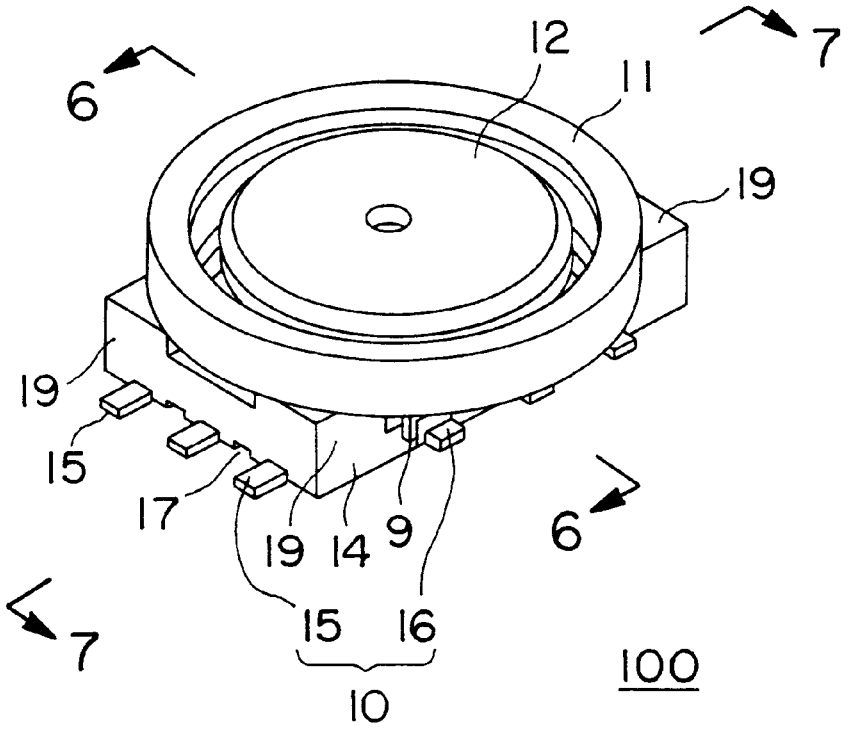
FIG. 2 is a perspective view of the inductor shown in FIG. 1 showing an appearance thereof.
Figure 3A:
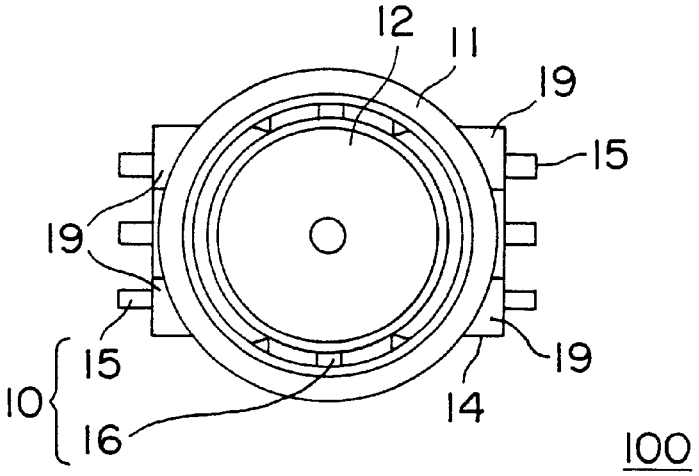
FIG. 3A is a top view.
Figure 3B:
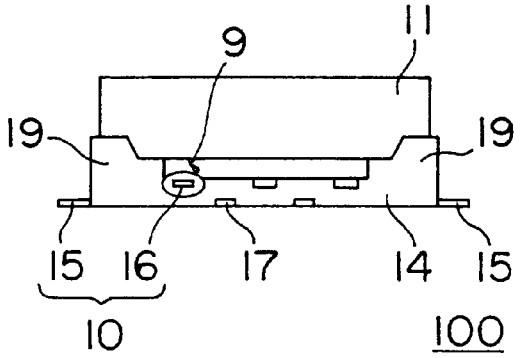
FIGS. 3B and 3C are side views.
Figure 3C:
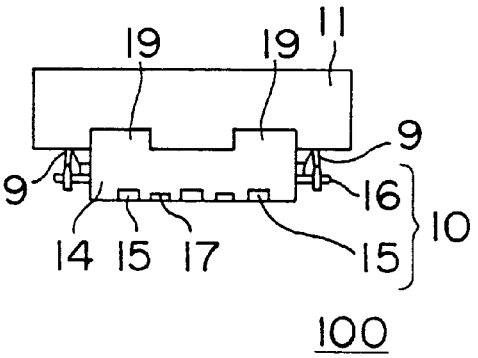
Figure 3D:
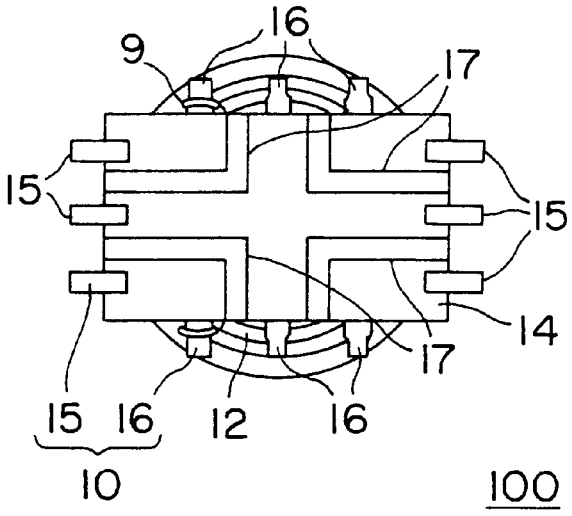
FIG. 3D is a bottom view of the inductor shown in FIG. 2.
Figure 5:
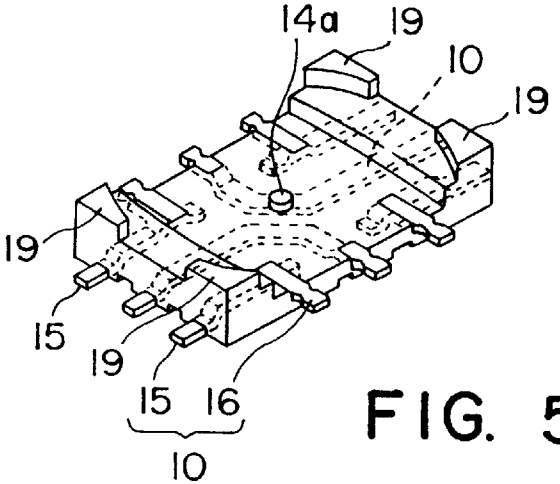
FIG. 5 is an isometric view of the terminal table and terminals of the inductor shown in FIG. 2, illustrating the inside portion thereof.
Figure 4:
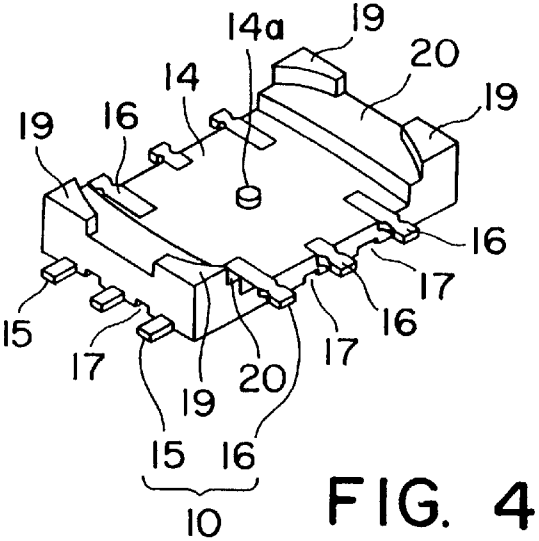
FIG. 4 is an isometric view of a terminal table and terminals of the inductor shown in FIG. 2.
Figure 7:
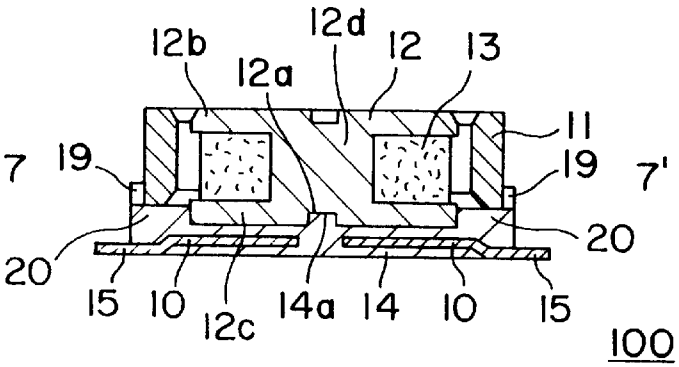
FIG. 7 is a cross sectional view of the inductor taken along lines 7—7 in FIG. 2.
Figure 6:
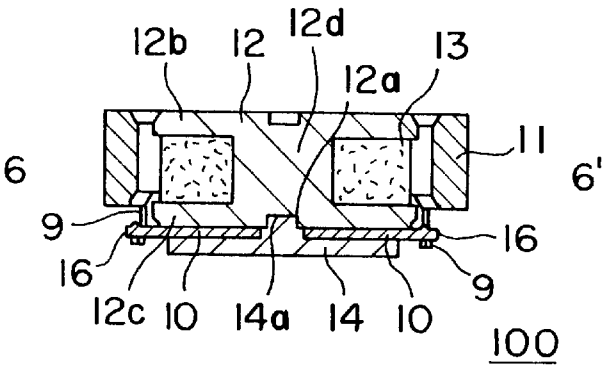
FIG. 6 is a cross sectional view of the inductor taken along lines 6—6 in FIG. 2.

FIG. 1 is a partially cut perspective view of an inductor 100 in an example according to the present invention. FIG. 2 is a perspective view showing an appearance thereof. FIG. 3A is a top view of the inductor 100, FIGS. 3B and 3C are side views of the inductor 100 seen in the directions of arrows 3B and 3C in FIG. 1, respectively. FIG. 3D is a bottom view of the inductor 100. FIG. 4 is an isometric view of a terminal table 14 and terminals of the inductor 100; and FIG. 5 is an isometric view showing the inside of the terminal table 14. FIG. 6 is a cross sectional view of the inductor 100 taken along lines 6—6 shown in FIG. 2. FIG. 7 is a cross sectional view of the inductor 100 taken along lines 7—7 shown in FIG. 2.

With reference to FIG. 1, an inductor 100 includes a generally rectangular parallelepiped terminal table 14, formed of an insulating material such as a heat-resistive resin, and six L-shaped conductors 10. In detail, the terminal table 14 and the L-shaped conductors 10 are formed by insert-molding so that the L-shaped conductors 10 each extend from a longer side of the terminal table 14 to a shorter side thereof. Two ends of each L-shaped conductors 10 are projecting from the respective side of the terminal table 14. Such projecting ends of the L-shaped conductor 10 are straight.

The projecting ends of the L-shaped conductors 10 on the shorter sides of the terminal table 14 each act as a terminal (hereinafter referred to as a "mounting terminal") 15 for mounting the inductor 100 on a printed circuit board. Each mounting terminal 15 is mounted on the printed circuit board in the state where a bottom surface thereof is in contact with the printed circuit board, and the bottom surface is on the same level as a bottom surface of the terminal table 14.

The projecting ends of the L-shaped conductor 10 on the longer sides of the terminal table 14 each act as a terminal (hereinafter referred to as a "winding terminal") 16 around which an end of a wire is allowed to be wound. Each winding terminal 16 is projecting from an intermediate level part in the thickness direction of the respective side surface of the terminal table 14. Thus, the winding terminals 16 are on a higher level than the mounting terminals 15.

Such a difference in level between the mounting terminals 15 and the winding terminals 16 is realized by bending each L-shaped conductor 10 to have a stepped portion. The stepped portion is buried in the terminal table 14.

Returning to FIG. 2, a drum-shaped core 12 is provided on a top surface of the terminal table 14. The drum-shaped core 12 is surrounded by a cylindrical core 11. The drum-shaped core 12 and the cylindrical core 11 form a magnetic core of the inductor 100.

As is shown in FIGS. 6 and 7, the drum-shaped core 12 has a top flange 12*b* including a top surface of the drum-shaped core 12, a bottom flange 12*c* including a bottom surface of the drum-shaped core 12, and a central part 12*d* interposed between the top and bottom flanges 12*b* and 12*c* and having a smaller diameter than the top and bottom flanges 12*b* and 12*c*. The bottom surface of the bottom flange 12*c* has a recess 12*a*. On the other hand, the terminal table 14 has a projecting portion 14*a* at the center portion of a top surface thereof. The drum-shaped core 12 is mounted on the terminal table 14 by engaging the projecting portion 14*a* in the recess 12*a*, and then is adhered on the terminal table 14.

A wire 13, for example, a copper wire, covered by an insulating material is wound around the central part 12*d* of the drum-shaped core 12. As is shown in FIG. 1, ends 9 of the wire 13 are wound around the winding terminals 16 for electric connection.

As is shown in FIGS. 4 and 5, the terminal table 14 has two stepped-up portions 20 on the top surface along the shorter sides thereof. Further, projecting portions 19 are provided at four corners of the top surface; that is, on the stepped-up portions 20. The projecting portions 19 and the stepped-up portions 20 are used for positioning the cylindrical core 11 and the drum-shaped core 12 on the terminal table 14.

The drum-shaped core 12 and the cylindrical core 11 are mounted on the terminal table 14 in the following manner.

First, the drum-shaped core 12 is positioned on the terminal table 14 by engaging the projecting portion 14*a* of the terminal table 14 in the recess 12*a* of the drum-shaped core 12. By forming each of the stepped-up portions 20 to have such a curved inner side surface as to match an outer circumferential surface of the bottom flange 12*c* of the drum-shaped core 12, the stepped-up portions 20 can be used also for horizontal positioning and holding of the drum-shaped core 12. Due to such a curved inner side surface, the positioning of the drum-shaped core 12 on the terminal table 14 can be performed more easily and more precisely. Such a shape of the stepped-up portions 20 also allows the drum-shaped core 12 to be supported by the terminal table 14 more securely.

The cylindrical core 11 forming an outer portion of the magnetic core is horizontally positioned on the terminal table 14 by contacting an outer circumferential surface of the cylindrical core 11 on an inner side surface of each projecting portion 19. Then, the cylindrical core 11 is adhered on the projecting portions 19. In order to allow the positioning of the cylindrical core 11 more easily, the inner side surface of each projecting portion 19 is formed to be curved so as to match the outer circumferential surface of the cylindrical core 11.

A bottom surface of the cylindrical core 11 is on the stepped-up portions 20. Thus, as is shown in FIGS. 6 and 7, there is a gap formed between the bottom surface of the bottom flange 12*c* of the drum-shaped core 12 and the bottom surface of the cylindrical core 11. The ends 9 of the wire 13 are drawn through the gap as is shown in FIGS. 3B and 3C in order to prevent the wire 13 from being disconnected.

As is shown in FIG. 3D, the bottom surface of the terminal table 14 has grooves 17 running from the longer sides to the shorter sides thereof. The grooves 17 have the following effect.

During a process for surface-mounting an inductor on a printed circuit board, a solder flux or a solder flux diluting agent often goes into the gap between the bottom surface of the inductor (namely, the bottom surface of the terminal table) and the printed circuit board. When the solder flux or the solder flux diluting agent which goes into the gap is vaporized by the heat used for soldering, the position at which the inductor is mounted is deviated by the pressure of the gas generated by the vaporization. In the case where the inductor has the grooves 17, the gas goes out through the grooves 17, thus preventing the deviation of the position of the inductor relative to the printed circuit board.

Figure 8:
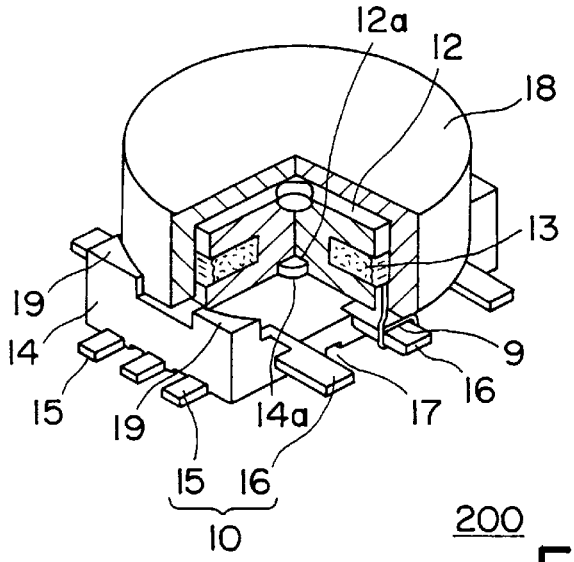
FIG. 8 is a partially cut perspective view of an inductor in a modification of the inductor shown in FIG. 2.

In the inductor 100 described above, the magnetic core includes the drum-shaped core 12 and the cylindrical core 11 surrounding the drum-shaped core 12. Alternatively, as in the case of an inductor 200 shown in FIG. 8, the cylindrical core 11 can be replaced with a cap-like core 18 which covers the drum-shaped core 12.

Figure 9:
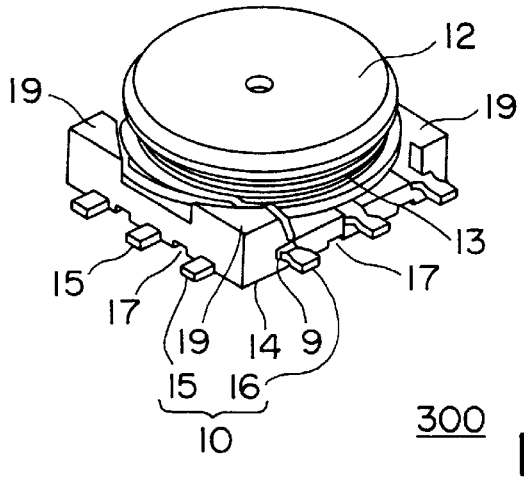
FIG. 9 is a partially cut perspective view of an inductor in another modification of the inductor shown in FIG. 2.

Still alternatively, as in the case of an inductor 300 shown in FIG. 9, a magnetic core can be formed only of the drum-shaped core 12. In such a case, the inductor 100 does not include any element equivalent to the cylindrical core 11. Accordingly, the drum-shaped core 12 can be positioned by the projecting portions 19 without the provision of the stepped-up portions 20. In detail, the outer circumferential surface of the bottom flange 12*c* of the drum-shaped core 12 is positioned along the inner side surfaces of the projecting portions 19. Thus, reduction in the number of the production steps and simplification of the shape of the elements can be achieved, resulting in reduction in the production cost.

With respect to FIGS. 10, 11A and 11B, a method for producing the inductor 100 will be described.

Figure 10:
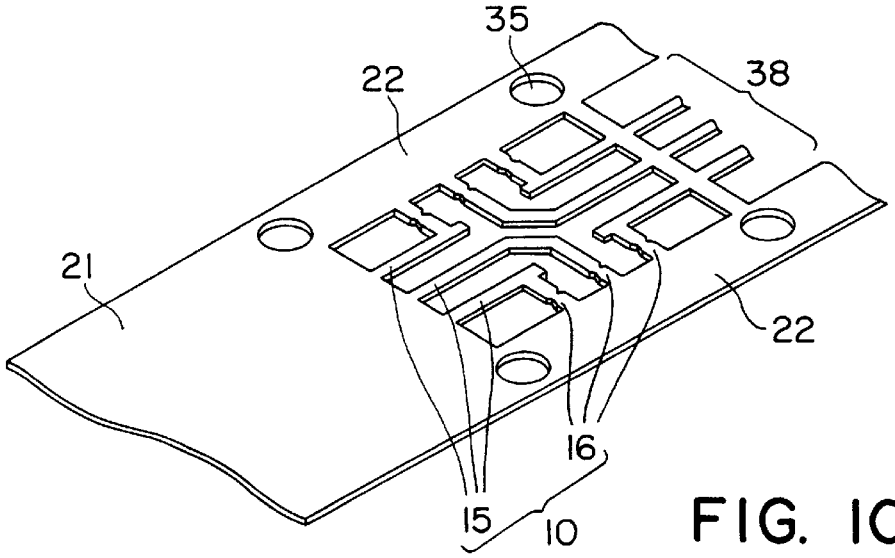
FIGS. 10 and 11A are isometric views of a strip-like metal plate, illustrating a method for producing the inductor shown in FIG. 2.

FIG. 10 is an isometric view of a strip-like metal plate 21 used for producing the inductor 100. FIG. 11A is an isometric view of the strip-like metal plate 21, illustrating a method for producing the inductor 100. In FIG. 11A, parts 110, 120, 130, 140, 150 and 160 respectively indicate various production steps of the inductor 100. FIG. 11B is a perspective view of the inductor 100 in a completed state. In FIGS. 11A and 11B, the grooves 17 are omitted for simplicity.

Figures 11A, 11B:
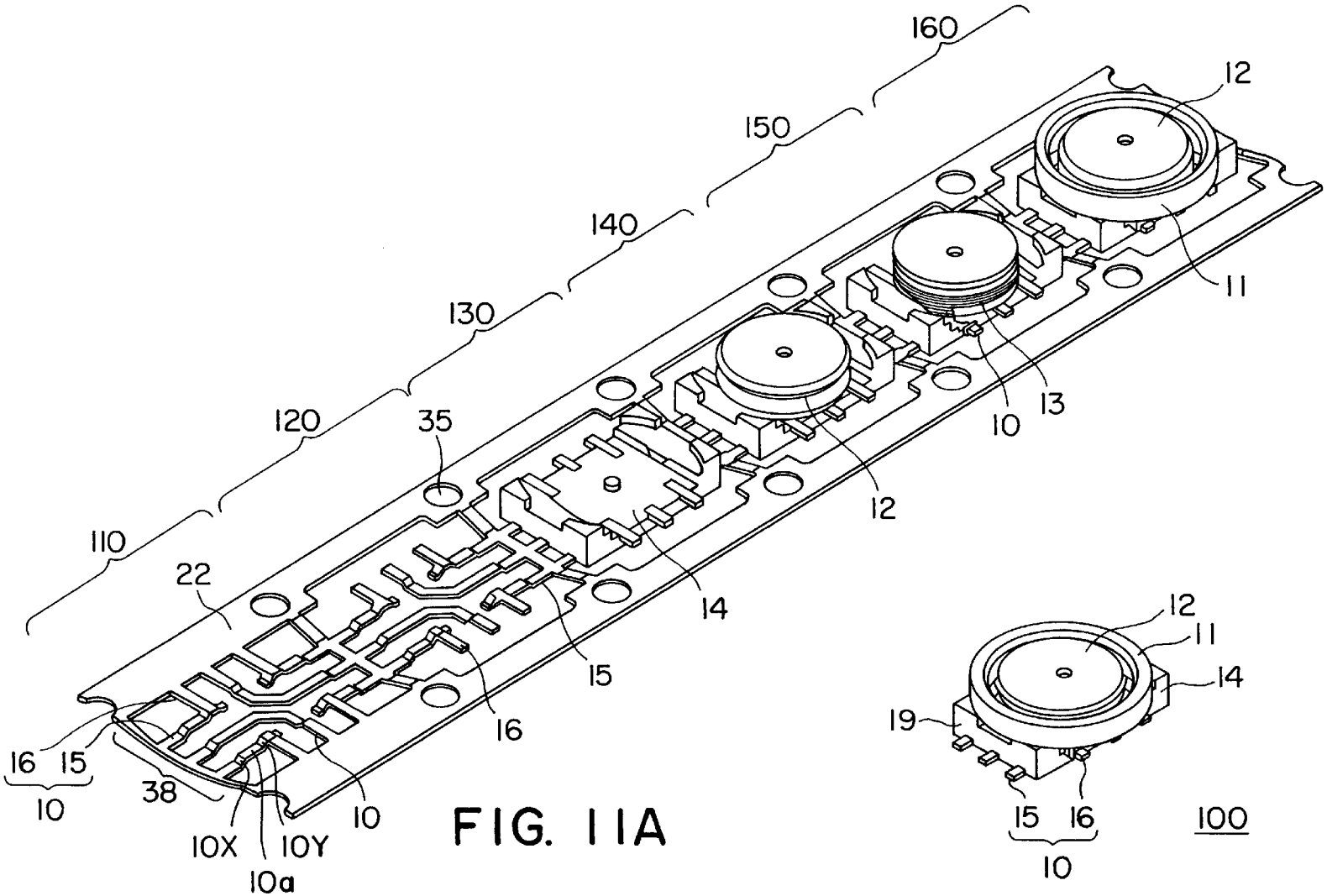
FIG. 11B is a perspective view of the inductor in a completed state.

As is shown in FIG. 10 and 11A, the strip-like metal plate 21 is treated with press working to form a prescribed pattern having a lead frame 22 extending along longitudinal sides of the metal plate 21 and a plurality of terminal areas 38 interposed between the two extending parts of the lead frame 22. Each terminal area 38 corresponds to one inductor 100. The lead frame 22 have a plurality of pairs of guide holes 35 formed at a prescribed interval. Each terminal area 38 is substantially rectangular and defined by two pairs of guide holes 35. Each terminal area 38 further include six L-shaped conductors 10 each of which has two ends to be formed into the winding terminal 16 and the mounting terminal 15.

The strip-like metal plate 21 is typically formed of phosphor bronze. Alternatively, german silver, brass, iron or the like can be used for the strip-like metal plate 21. The width of the strip-like metal plate 21 (perpendicular to the longitudinal direction) is typically approximately 8 mm to 24 mm, and preferably approximately 12 mm. The thickness of the strip-like metal plate 21 is typically approximately 0.1 mm to 0.4 mm and preferably approximately 0.2 mm.

Next, as is shown in part 110 in FIG. 11A, the L-shaped conductors 10 are bent by a clamping pressure system to have a stepped portion. Thus, each L-shaped conductor 10 is shaped so that one of the two ends thereof to be the mounting terminal 15 projects downward from the level of the lead frame 22 and that the other end thereof to be the winding terminal 16 projects upward from the level of the lead frame 22. Thus, the level of the mounting terminal 15 and the level of the winding terminal 16 have a prescribed difference.

The bending process is performed in two stages. In a first stage, the L-shaped conductor 10 are bent at a position 10X between the end to be the mounting terminal 15 and an intermediate step 10*a*. In a second stage, the L-shaped conductor 10 is bent at a position 10Y between the intermediate step 10*a* and the end to be the winding terminal 16. The bending process is performed in two stages for the following reason.

The level difference between the winding terminal 16 and the mounting terminal 15 is approximately 0.2 mm to 1.0 mm and preferably 0.4 mm. The precision of press working is not necessarily sufficiently high. Accordingly, in the case of performing a one-stage bending process to obtain the above-mentioned level difference, a sufficiently high size precision as required cannot be achieved because of a large tensile stress applied to the L-shaped conductor 10. A multiple-stage bending process of bending the L-shaped conductor 10 at a plurality of positions is adopted in order to achieve the prescribed high precision.

At the next step, as is shown in part 120 in FIG. 11A, the ends of the L-shaped conductor 10 to be the winding terminals 16 are cut off from the lead frame 22.

As is shown in part 130 in FIG. 11A, the terminal table 14 is provided in the terminal area 38 by insert molding. In detail, the terminal table 14 is formed by injecting a molten resin into a mold in a resin molding apparatus and inserting a part of the terminal area 38 in the molten resin before the resin is solidified. Before such insert molding, the strip-like metal plate 21 is set in the resin molding apparatus using the guide holes 35. The ends to be the winding terminals 16 are cut off from the lead frame 22 immediately before the insert-molding of the terminal table 14. The guide holes 35 are also used for rolling the strip-like metal plate 21 around a reel for temporary storage during the production of the inductor 100.

The terminal table 14 is typically formed of an epoxy resin. Alternatively, a phenol resin, a diallylphthalate resin or a polybutadieneterephthalate, or the like can be used for the terminal table 14.

Next, as is shown in part 140 in FIG. 11A, the drum-shaped core 12 formed of ferrite is provided on a top surface of the terminal table 14 as a part of the magnetic core. As is shown in part 150 in FIG. 11A, a wire 13 formed of a copper wire covered with an insulating material is wound around the central part 12*d* of the drum-shaped core 12. Then, the ends 9 of the wire 13 are wound around the winding terminals 16 to be connected to the terminal table 14.

As is shown in part 160 in FIG. 11A, the cylindrical core 11 formed of ferrite is fixed on the terminal table 14. The mounting terminals 15 are cut off from the lead frame 22 to obtain the inductor 100 shown in FIG. 11B.

The above-described method for producing the inductor 100 has the following features.

The inductor 100 is separated from the lead frame 22 of the strip-like metal plate 21 at the final step of the production method, but not immediately after the terminal table 14 is formed by insert molding. The assembly of the inductor 100 after the formation of the terminal table 14 is performed in the state where the terminal table 14 is still connected to the lead frame 22. Accordingly, the inductor 100 is not transported in the state of being half-completed, thus restricting the mechanical stress applied to the mounting terminals 15 and the winding terminals 16. As a result, the L-shaped conductors 10 are not deformed and are improved in size precision and reliability.

As is described above, the winding terminals 16 which are formed by the bending the L-shaped conductor 10 are cut off immediately before the formation of the terminal table 14. Thus, the terminal table 14 which is connected to the strip-like metal plate 21 by insert molding is not directly connected to the lead frame 22.

Generally, a strip-like metal plate is wound around a reel in order to temporarily store the strip-like metal plate during the production process of an inductor. While the strip-like metal plate is being rolled around the reel, a stress is applied to the lead frame in a longitudinal direction thereof. In the above-described method according to the present invention, even if such a stress is applied to the lead frame 22, the terminal table 14 is not supplied with a mechanical stress, thus preventing breakage of or generation of cracks in the terminal table 14.

The method described above is for producing the inductor 100 including the cylindrical core 11 and the drum-shaped core 12. The inductors 200 and 300 (FIGS. 8 and 9) can also be produced in similar manners.

Figures 12A, 12B:
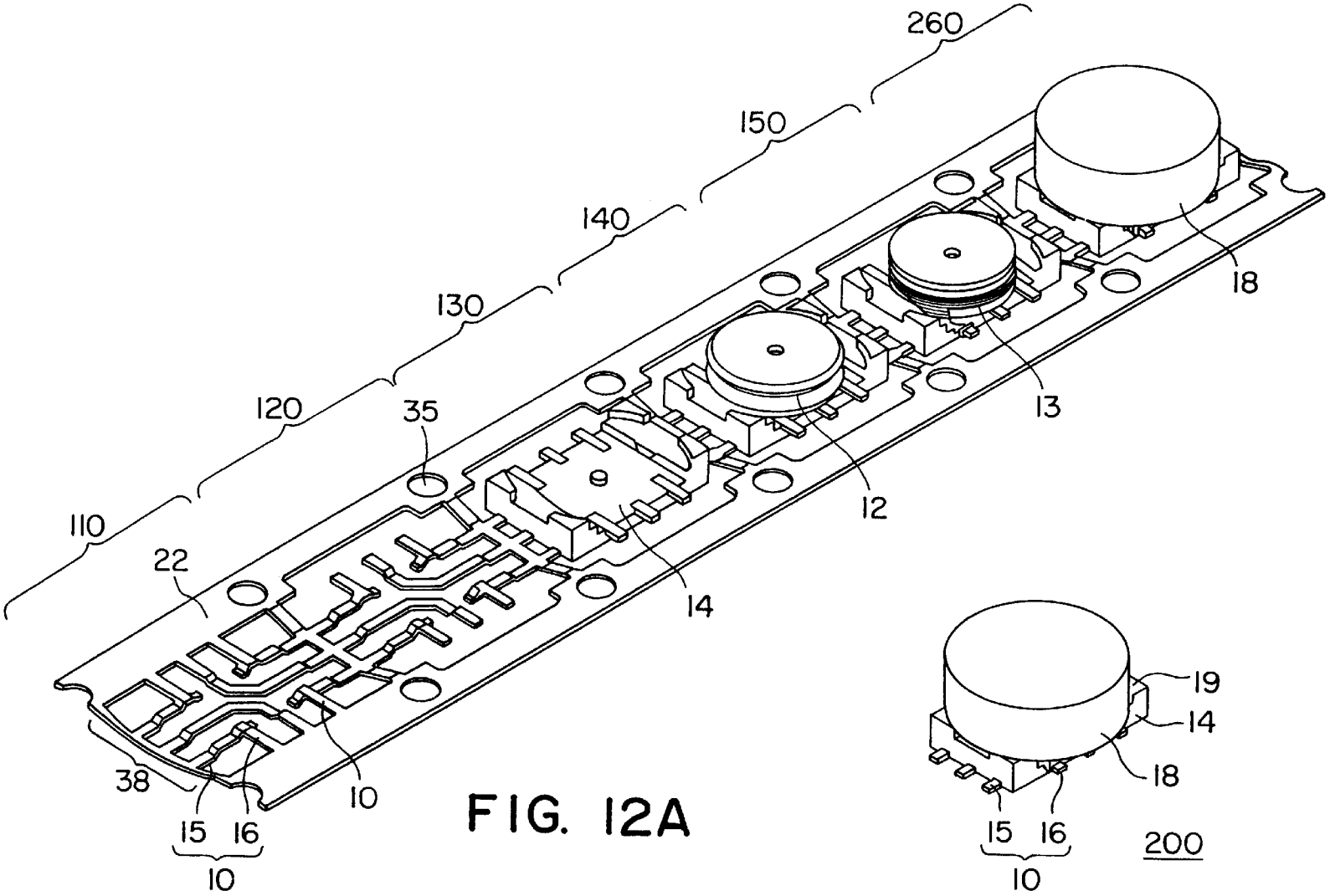
FIG. 12A is an isometric view of a strip-like metal plate, illustrating a method for producing the inductor shown in FIG. 8.
FIG. 12B is a perspective view of the inductor shown in FIG. 8 in a completed state.

FIG. 12A shows various steps of a method -for producing the inductor 200 including the cap-like core 18 which covers the drum-shaped core 12. The cap-like core 18 is mounted after the provision of the drum-shaped core 12 and the connection of the wire 13 to the winding terminal 16, as is shown in part 260 in FIG. 12A. After the cap-like core 18 is mounted, the mounting terminals 15 are cut off from the lead frame 22 to obtain the inductor 200 shown in FIG. 12B. The other production steps of the inductor 200 shown in FIG. 12A are the same as the corresponding producing steps of the inductor 100 shown in FIG. 11A.

Figures 13A, 13B:
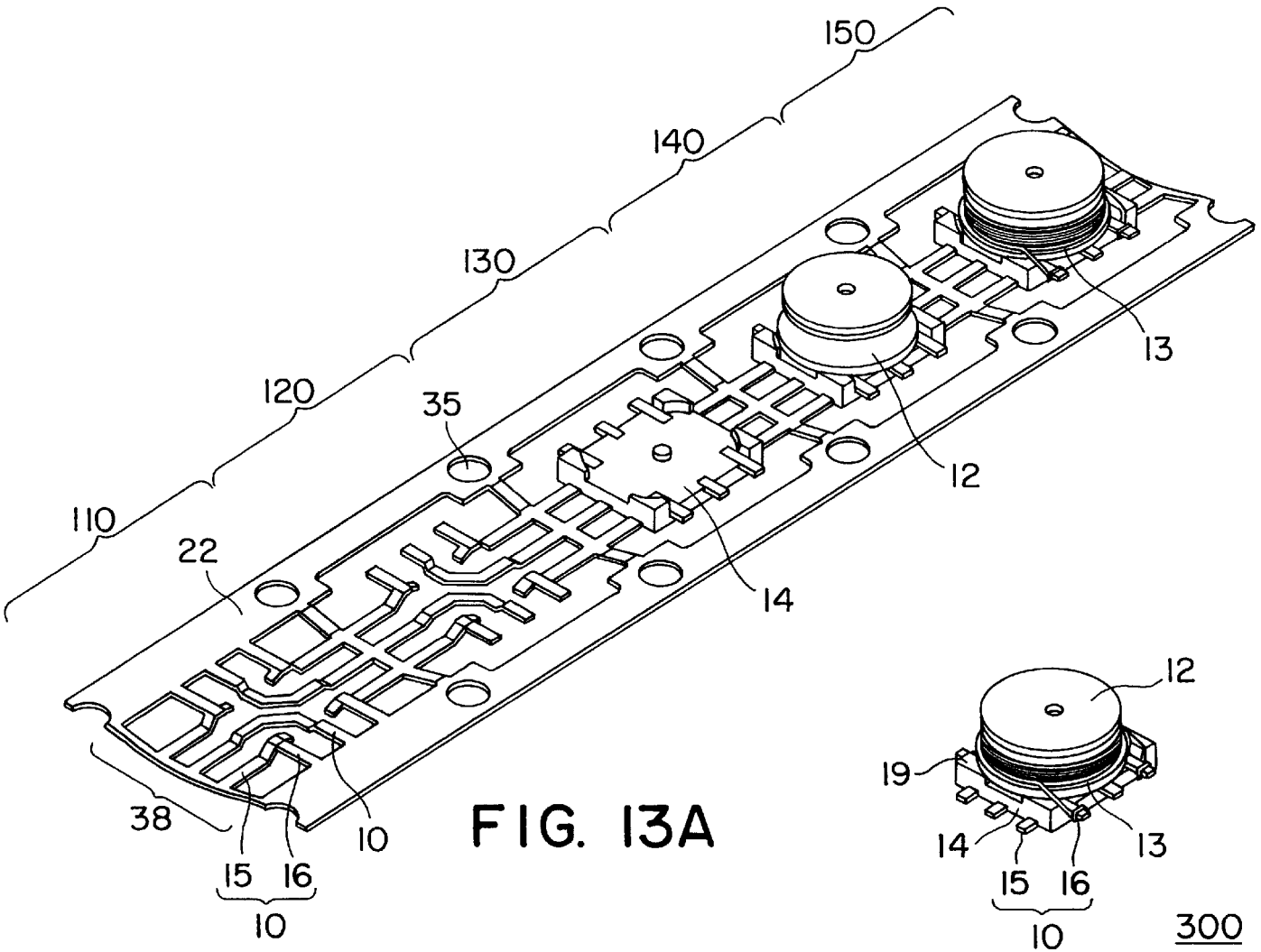
FIG. 13A is an isometric view of a strip-like metal plate, illustrating a method for producing the inductor shown in FIG. 9.
FIG. 13B is a perspective view of the inductor shown in FIG. 9 in a completed state.
Figure 14:
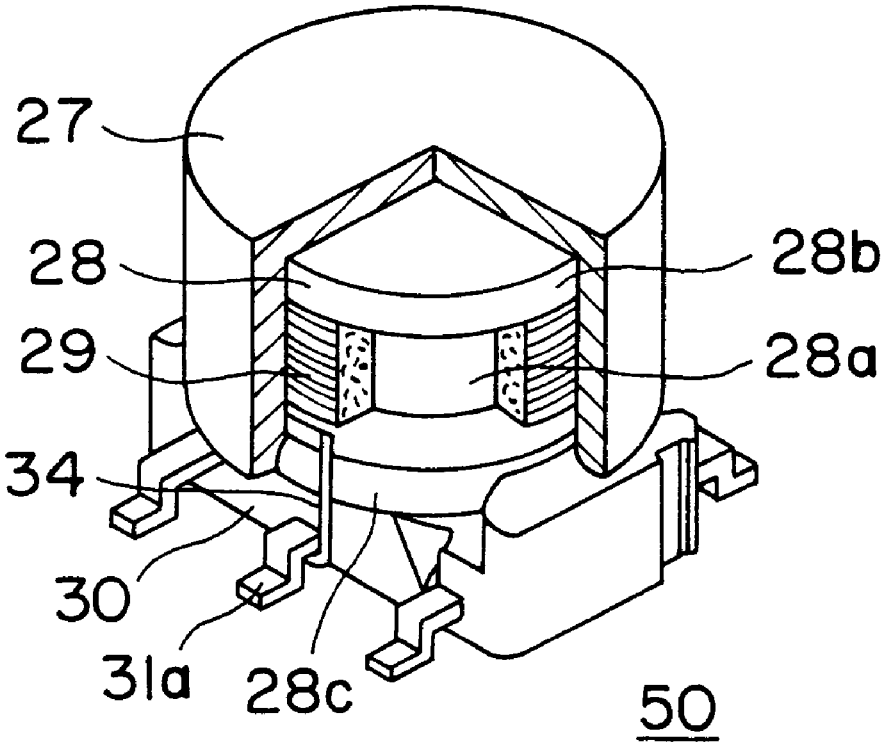
FIG. 14 PRIOR ART
FIG. 14 is a perspective view of a conventional inductor.
Figure 15:
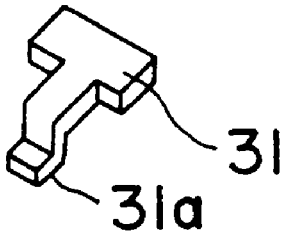
FIG. 15 PRIOR ART
FIG. 15 is an isometric view of a terminal of the conventional inductor shown in FIG. 14.
Figure 16A:
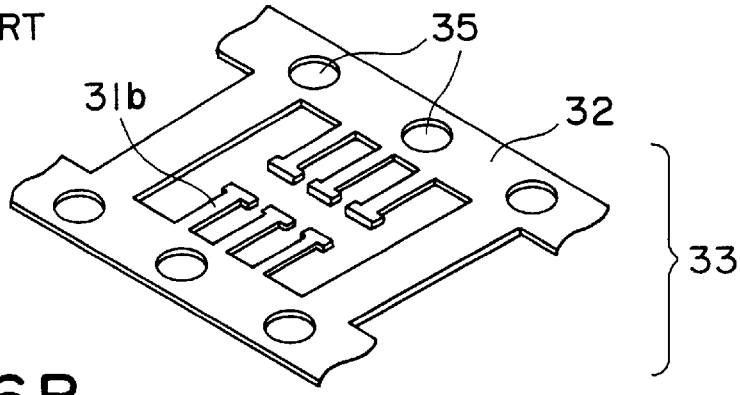
FIG. 16A PRIOR ART
FIGS. 16A through 16E are isometric views illustrating various steps of a method for producing the inductor shown in FIG. 14.
Figure 16B:
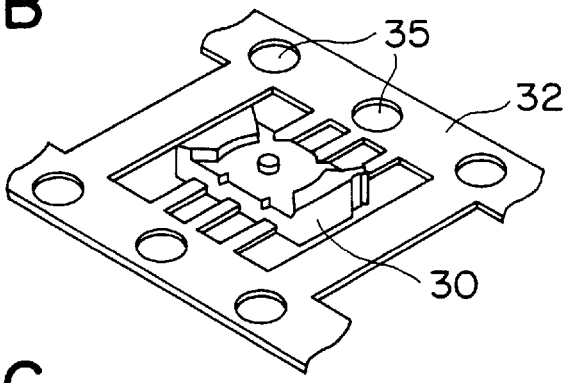
FIG. 16B PRIOR ART
Figure 16C:
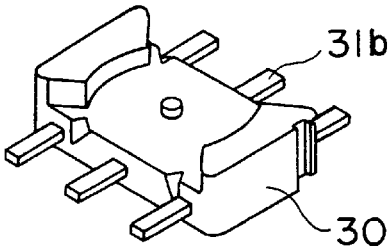
FIG. 16C PRIOR ART
Figure 16D:
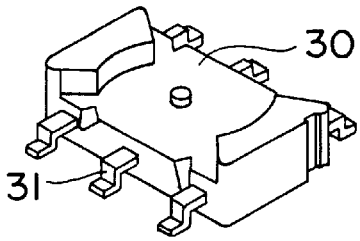
FIG. 16D PRIOR ART
Figure 16E:
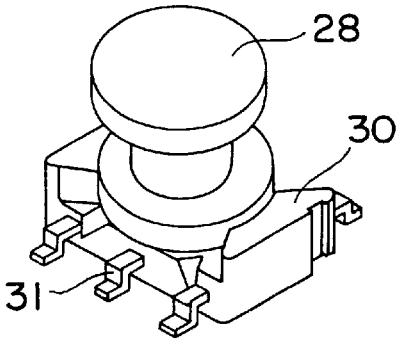
FIG. 16E PRIOR ART

FIG. 13A shows various steps of a method for producing the inductor 300 in which only the drum-shaped core 12 forms the magnetic core. After the provision of the drum-shaped core 12 and the connection of the wire 13 to the winding terminal 16 (part 150 in FIG. 13A), the mounting terminals 15 are cut off from the lead frame 22 to obtain the inductor 300 shown in FIG. 13B. The other production steps of the inductor 300 shown in FIG. 13A are the same as the corresponding producing steps of the inductor 100 shown in FIG. 11A.

In the bending process of the L-shaped conductors 10, the pressing pressure in the first stage and the second stage is typically approximately 20 $N/cm^2$ to 100 $N/cm^2$, and preferably approximately 50 $N/cm^2$. The pressing pressure can be set at any optimum value in accordance with the material, the thickness and the like of the strip-like metal plate 21.

In the above-described example, the L-shaped conductors 10 are treated with a two-stage bending process; however, the present invention is not limited to this. A three- or more-stage bending process can be adopted in accordance with a prescribed level difference between the mounting terminal 15 and the winding terminal 16, i.e., the size of the terminal table 14. In the case where the prescribed level difference between the mounting terminal 15 and the winding terminal 16 is not sufficiently large, a one-stage bending process can be used.

The parameters for the press working and insert molding in the other steps can be the same as in conventional methods, and detailed description thereof will be omitted.

The materials for the strip-like metal plate 21 and the terminal table 14 are not limited to those mentioned above.

The bottom surface of the terminal table 14 can be square instead of rectangular.

As has been described so far, in an inductor according to the present invention, the winding terminals around which the ends of the wire are wound are projecting from an intermediate level part of the side surface of the terminal table. The mounting terminals used for connection of the inductor to a printed circuit board have a bottom surface which is on the same level as the bottom surface of the terminal table. The mounting terminals and the winding terminals of the inductor according to the present invention are independent from each other, whereas the same type of conductors are used for mounting terminals and winding terminals in a conventional inductor. According to the present invention, the mounting terminals and the winding terminals extend straight from the terminal table without being bent outside the terminal table.

Due to such mounting terminals and winding terminals, deterioration in mechanical strength of the inductor is prevented. Further, the size precision of the terminals is improved, and deformation thereof is avoided. Thus, the mounting qualities such as positional precision with respect to the printed circuit board and mounting reliability are improved.

Since the element or the elements of the magnetic core can be positioned and held by the projections (for example, the projecting portions 19 and the stepped-up portions 20) on the terminal table, the inductor can be assembled more easily and be more stably seated.

Since the inductor is separated from the lead frame at the final stage of the production, the inductor is not transported in the state of being half-completed. Thus, application of a mechanical stress on the terminals can be avoided, thus realizing improvement in size precision and prevention of deformation of the terminals. As a result, reliability is enhanced.

The winding terminals formed by bending the L-shaped conductors and extending in a width direction of the strip-like metal plate are cut off from the lead frame immediately before the formation of the terminal table. Accordingly, the terminal table is not supplied with a mechanical stress even if a mechanical stress is applied to the lead frame when, for example, the strip-like metal plate is rolled around a reel for temporary storage, thus preventing breakage of or generation of cracks in the terminal table.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for producing an inductor, comprising the steps of:

treating a strip-like metal plate with press working to form a lead frame and a terminal area interposed between two areas of the lead frame extending in a longitudinal direction of the strip-like metal plate, the lead frame and the terminal area being formed in a prescribed pattern;

mounting a terminal table on the terminal area;

mounting a magnetic core on the terminal table;

winding a wire around the magnetic core; and separating an assembly including the terminal table, magnetic core, and the wire from the lead frame, wherein the terminal area includes a plurality of L-shaped conductors, and the step of treating the strip-like metal plate with press working includes the step of bending the L-shaped conductors a plurality of times to form a plurality of stepped portions in each of the L-shaped conductors and obtain a prescribed level difference between a level of one of two ends of each L-shaped conductor and a level of the other end of the L-shaped conductor, so that each of the L-shaped conductors includes at least one intermediate step which is positioned at a level between the levels of the respective two ends thereof.

2. A method according to claim 1, wherein the prescribed level difference is approximately 0.2 mm to 1.0 mm.

3. A method according to claim 1, further including the step of cutting off a part of each of the plurality of L-shaped conductors extending in a width direction of the strip-like metal plate from the lead frame before the step of mounting the terminal table.

4. A method according to claim 1, wherein:

one of the two ends which is on a higher level than the stepped portions acts as a winding terminal around which the wire is allowed to be wound, and the other end which is on a lower level than the stepped portions acts as a mounting terminal used for mounting of the inductor, and the terminal table is mounted on the terminal area in such a manner as to allow the winding terminal to project from a higher level of a side surface of the terminal table than the mounting terminal.

* * * * *